United States Patent [19]

Barlow

[11] Patent Number: 4,464,427

[45] Date of Patent: Aug. 7, 1984

[54] PREFORMED MEMBRANE

[75] Inventor: Peter L. Barlow, Guilden Sutton, England

[73] Assignee: Shell Oil Company, Houston, Tex.

[21] Appl. No.: 493,804

[22] Filed: May 17, 1983

Related U.S. Application Data

[63] Continuation of Ser. No. 373,830, May 3, 1982, abandoned.

[30] Foreign Application Priority Data

Jun. 29, 1981 [GB] United Kingdom ..... 8119949

[51] Int. Cl.[3] ..... B32B 11/00; C08L 91/00

[52] U.S. Cl. ..... 428/40; 428/143; 428/291; 428/489; 524/68

[58] Field of Search ..... 428/40, 143, 291, 489; 524/62, 68, 505; 525/901

[56] References Cited

U.S. PATENT DOCUMENTS

| | | | |
|---|---|---|---|
| 4,091,135 | 5/1978 | Tajima et al. | 428/489 |
| 4,146,635 | 3/1979 | Eigenmann | 428/489 |
| 4,196,115 | 4/1980 | Bresson | 524/68 |
| 4,251,586 | 2/1981 | Marzocchi et al. | 428/489 |

FOREIGN PATENT DOCUMENTS 1201135 8/1970 United Kingdom .

*Primary Examiner*—Paul J. Thibodeau
*Attorney, Agent, or Firm*—Peter A. Bielinski

[57] ABSTRACT

A preformed membrane, suitable for road surfacing, comprises a layer of a mixture of bitumen, a linear monoalkenyl arene/conjugated diene block copolymer and a branched monoalkenyl arene/conjugated diene block copolymer.

6 Claims, No Drawings

PREFORMED MEMBRANE

This is a continuation of application Ser. No. 373,830, filed May 3, 1982 and now abandoned.

BACKGROUND OF THE INVENTION

1. Field of the Invention

This invention relates to a preformed membrane comprising a bitumen/thermoplastic rubber layer, which membrane is suitable for road surfacing and maintenance. Further, this invention relates to the use of this membrane on a surface, preferably using a tack coat, and to certain novel mixtures of bitumen and thermoplastic rubbers.

2. Description of the Prior Art

Road repair, while always a significant problem, is now quickly becoming a critical problem in the United States. Road surfaces are aging and crumbling while the money available to communities to repair roads is shrinking. One means to lower repair costs and improve wear resistance is through use of preformed membranes. Preformed membranes, which are suitable for road surfacing or road repair and which comprise a bitumen/rubber layer are known, e.g., from U.S. Pat. Nos. 3,853,682 and 3,930,100. However, these membranes are far from ideal.

Membranes formed from a bitumen/thermoplastic rubber layer have to fulfill a number of requirements. They must be sufficiently flexible at low ambient temperatures to prevent the formation of cracks, have sufficient consistency at high ambient temperatures to withstand high traffic loads, have sufficient binding capability to retain chippings, show a good weathering resistance, and a high penetration index. With preformed membranes comprising such a layer it would be possible to extend the period in the year when resurfacing and maintenance can be carried out. It would furthermore be possible to use the road immediately after the membrane has been laid. It has now been found that these targets can be met by using a special mixture of bitumen and thermoplastic rubbers.

SUMMARY OF THE INVENTION

This invention relates to a preformed membrane suitable for road surfacing, comprising a layer of a mixture of bitumen, a linear monoalkenyl arene/conjugated diene block copolymer and a branched monoalkenyl arene/conjugated diene block copolymer. More particularly, the present invention is a preformed membrane comprising a layer of a mixture of:

(a) a bitumen;

(b) a linear ABA block copolymer, each block A being a monoalkenyl arene polymer having an average molecular weight between about 7,500 to 100,000, each block B being an isoprene polymer having an average molecular weight between about 25,000 to 1,000,000; and (c) a radial $(A'—B')_nB'—A'$ block copolymer, each block A' being a monoalkenyl arene polymer having an average molecular weight between about 7,500 to 100,000, each block B' being a butadiene polymer having an average molecular weight between about 25,000 and 1,000,000, n being over 1.

Membranes according to the present invention have a number of advantages. In particular, they have excellent flexibility at low ambient temperatures, good consistency at high ambient temperatures, good binding capability, good weathering resistance and a high penetration index. Moreover, these membranes show superior properties when used for road surfacing or road repair.

DETAILED DESCRIPTION OF THE INVENTION

The bitumen employed herein preferably is a petroleum bitumen, in particular a precipitation bitumen, such as propane bitumen blended with a flux oil such as an aromatic petroleum extract, e.g., a Bright Stock furfural extract. The proportion of flux oil may be up to 50% w, e.g., 5–40% w, based on bitumen and flux oil. The penetration of the bitumen may be e.g., 10 to 500 (ASTM No. D 5–73, 25° C., 0.1 mm) and the softening point may be e.g., 10° to 100° C. (Ring and Ball, ASTM No. D 36–76). Suitable bitumens are described in British patent specification No. 1,201,135, which disclosure is herein incorporated by reference.

The block copolymer component of the present invention is a mixture of a linear ABA type block copolymer and a radial $(A'—B')_nB'—A'$ block copolymer where n is over 1. Preferably, n varies from over 1 to 15, more preferably from about 2 to about 6. The A blocks are monoalkenyl arene polymer blocks, the B blocks are elastomeric polyisoprene blocks, and the B' blocks are elastomeric polybutadiene blocks. Typical linear block copolymers have the structure polystyrene-polyisoprene-polystyrene. A typical radial polymer would comprise one in which the diene block has three or more branches, the tip of each branch being connected to a polystyrene block. See U.S. Pat. No. 3,594,452. Other useful monoalkenyl arenes from which the thermoplastic (nonelastomeric) blocks may be formed include alphamethyl styrene, tert-butyl styrene and other ring alkylated styrenes as well as mixtures of the same. The conjugated diene monomer is butadiene or isoprene.

The use of both a linear and a radial block copolymer results in improved properties for the mixture compared to the use of just a linear copolymer or just a radial copolymer. In particular, the radial copolymers give superior visco-elastic properties.

The average molecular weights of each of the blocks may be varied as desired. The monoalkenyl arene polymer blocks preferably have number average molecular weights between about 7,500 and about 100,000, more preferably between about 8,000 and about 25,000. The elastomeric conjugated diene polymer blocks preferably have number average molecular weights between about 25,000 and about 1,000,000, more preferably between about 25,000 and about 250,000. The average molecular weights of the polystyrene end blocks are determined by gel permeation chromatography, whereas the polystyrene content of the polymer is measured by infrared spectroscopy of the finished block polymer. The weight percentage of the thermoplastic monoalkenyl arene blocks in the finished block polymer should be between about 8 and 75%, preferably between about 20% and about 50% by weight. The general type and preparation of these block copolymers are described in U.S. Pat. No. Re. 28,246 and in many other U.S. and foreign patents.

The block copolymers useful in the compositions of this invention may also be hydrogenated either selectively, randomly or completely. Selected conditions may be employed, for example, to hydrogenate the elastomeric diene center block while not so modifying the monoalkenyl arene polymer end blocks. An example of a hydrogenated linear polymer is polystyrene-hydrogenated polyisoprene-polystyrene. Preferably blocks A and A' are characterized in that no more than about 25% of the original aromatic double bonds are reduced by hydrogenation while blocks B and B' are characterized by having at least 75% of the aliphatic double bonds reduced by hydrogenation. See generally U.S. Pat. No. 3,595,942.

The proportion of the linear and branched block copolymers suitably is about 1 to about 20% w, preferably about 1 to about 10% w, each, based on the bitumen/copolymer mixture.

From French patent application No. 2,360,630 mixtures of bitumen, a linear styrene/butadiene block copolymer and a branched styrene/butadiene block copolymer are known as binders for road building. Preformed membranes and the use of styrene-isoprene block copolymers are not mentioned, however.

This mixture may contain additional ingredients, such as resins, fillers, e.g., mineral fillers or meltable fillers such as wax-like materials, e.g., a petroleum wax or a polyolefin wax. It may also contain mineral or organic fibers, soot, mineral aggregates, natural rubber, such as rubber scrap, other organic polymers, etc. Mixtures of these ingredients can also be used.

The thickness of the bitumen/copolymer layer suitably is 0.2–20 mm, e.g., 0.5–10 mm. The width of this layer can e.g. be 1–500 cm, suitably 5–200 cm. The length suitably is 1.25 m or more, e.g., 2–10 m.

This layer preferably is reinforced, e.g. with a woven or unwoven fabric of e.g. polypropylene, polyamide, polyester, glass fibers, etc., preferably woven flat polypropylene fibers or glass fibers.

The layer may be provided on one or both sides with a backing sheet, e.g. a paper sheet or a flexible plastic sheet, such as a polyethylene, polypropylene, polyvinyl chloride, polystyrene sheet, or a metal foil, such as an aluminium, copper or lead foil, or a release layer, such as siliconized paper.

Preferably one side is provided with a release layer, which has release properties on both sides, whereafter the membrane is rolled up. Alternatively one side is provided with a release layer and the other side with a backing sheet or with sand or, preferably, with aggregates such as stone chippings of e.g. 1–30 mm, the latter ones either during manufacture or at the site of application. Coloured materials, such as coloured fine gravel and light-reflective materials can also be used to form signalling or road-marking means or for decorative purposes. It is also possible to use a backing sheet consisting of or comprising such marking materials. Another possibility is first to apply on the side of the layer opposite to the release layer a pattern, e.g. strips, of marking material and then applying the aggregates to cover the non-marked parts of that side.

The present membrane may e.g. be manufactured by unrolling siliconized paper on to a conveyor belt, together with a polypropylene fabric on top of the paper, and pouring the molten bitumen/polymer mixture, e.g. heated at a temperature of 100°–200° C., or an emulsion of this mixture on the fabric thus impregnating it, and subsequently spreading stone chippings, optionally preheated or coated with bitumen or with a transparent material or with a road-marking material on the still warm membrane, cooling and membrane, if desired cutting it and rolling it up for transport.

At the site of use the roll is unrolled while removing the release paper and the membrane is pressed on the surface to be covered, e.g. an asphalt or concrete road or pavement surface or any other surface, e.g. a surface on bridges and buildings, preferably after having applied a tack coat on this surface.

A suitable tack coat or primer is a mixture of a volatile solvent, a thermoplastic rubber and a resin, e.g. such as described in British patent specification No. 1,033,115. A preferred mixture comprises 10% w polystyrene/polybutadiene/polystyrene thermoplastic rubber, 10% w of a resin such as a pentaerythritol ester of hydrogenated resin, 64% w ethyl acetate and 16% toluene.

The membrane may also be used for roofing, flooring, in the building industry and for hydraulic works. It is particularly suitable for parking places, e.g. multi-storey carparks, for rural roads, runways, for sealing purposes and for repair purposes, e.g. road repair, e.g. in the form of tiles or patches.

The invention is further illustrated by means of the following illustrative embodiment, which is given for the purpose of illustration alone and is not meant to limit the invention to the particular reactants and amounts disclosed.

ILLUSTRATIVE EMBODIMENT

The composition employed herein comprised the following (expressed as percent by weight):

| | |
|---|---|
| Propane bitumen | 60 |
| Bright Stock furfural extract | 35 |
| Linear polystyrene/polyisoprene/polystyrene block copolymer (mol. wt. 11,000/200,000/11,000) | 1.5 |
| Star-shaped polystyrene/polybutadiene block copolymer (mol. wt. 21,000/84,000 per arm) having 4 arms | 3.5 |

The propane bitumen and the extract were preblended. The pre-blend had a penetration of 304 dmm, a softening point of 34° C. and a penetration index of −1.0. For the final mixture these figures were 163, 82 and +8.7, respectively.

This binder was applied onto a woven glass fiber membrane, 50 cm wide, on top of a one-sided siliconized paper to form a membrane having a thickness of 1.5 mm. Subsequently, bitumen-coated stone chippings having a size of 6 mm were spread on the still warm membrane in a quantity of 6 kg/m$^2$. The resulting membrane was laid on a hot-rolled asphalt surface which had been laid over a construction joint on a motorway flyover using a tack coat, which joint had severely cracked the asphalt. After 10 months of heavy traffic the crack is still bridged and the material is in an excellent condition.

This membrane was also applied onto multi-storey carparks to retexture the ramps after they had become slippery. After half a year the material was still in an excellent condition.

What is claimed is:

1. A preformed membrane suitable for road surfacing and maintenance comprising a layer of a mixture of:

(a) a bitumen;

(b) from about 1 to about 10 percent by weight of a linear ABA block copolymer, each block A being a monoalkenyl arene polymer having an average molecular weight between about 7,500 and 100,000, each block B being an isoprene polymer having an average molecular weight between about 25,000 and 1,000,000; and (c) from about 1 to about 10 percent by weight of a radial $(A'—B')_nB'—A'$ block copolymer, each block A' being a monoalkenyl arene polymer having an average molecular weight between about 7,500 and 100,000, each block B' being a butadiene polymer having an average molecular weight between about 25,000 and 1,000,000, n being over 1.

2. The membrane according to claim 1, wherein the bitumen is a blend of propane bitumen and a flux oil.

3. The membrane according to claim 1 wherein said linear copolymer is a polystyrene-polyisoprene-polystyrene block copolymer and said radial copolymer is a star copolymer of styrene and butadiene where n is between 1 and 15.

4. The membrane according to claim 1, wherein the layer is reinforced with a fabric.

5. The membrane according to claim 1, wherein one side of the layer is provided with a release paper and the other side with aggregates.

6. The use of a membrane according to claim 1 on a surface after having applied a tack coat on this surface.

* * * * *